US005181544A

United States Patent [19]

Deiuri

[11] Patent Number: 5,181,544

[45] Date of Patent: Jan. 26, 1993

[54] DELIVERY DEVICE WITH AUTOMATIC THREADING SYSTEM FOR WEFT STORAGE DRUM

[75] Inventor: Adriano Deiuri, Taverne, Switzerland

[73] Assignee: SOBREVIN Société de brevets industriels-Etablissement, Vaduz, Liechtenstein

[21] Appl. No.: 647,052

[22] Filed: Jan. 29, 1991

[30] Foreign Application Priority Data

Mar. 7, 1990 [DE] Fed. Rep. of Germany ..... 4007131

[51] Int. Cl.[5] ..... D03D 47/34

[52] U.S. Cl. ..... 139/452; 242/47.01

[58] Field of Search ..... 242/47.01; 139/452, 139/435.1

[56] References Cited

U.S. PATENT DOCUMENTS 5,016,680 5/1991 Mitsuya et al. ..... 139/452

FOREIGN PATENT DOCUMENTS 0355281 2/1990 European Pat. Off. ..... 139/435.1

3734284 4/1989 Fed. Rep. of Germany .

*Primary Examiner*—Andrew M. Falik

*Attorney, Agent, or Firm*—Martin A. Farber

[57] ABSTRACT

A delivery device for traveling thread for textile machines having a storage drum to which the thread is fed in a rearward region by a thread guide tube which revolves around the storage drum and from which the thread is withdrawn overhead through a thread withdrawal eye. An automatic threading of the thread is effected by compressed air such that the thread is blown through the thread guide tube, deflected at its exit mouth side parallel to an outer surface of the drum and conducted on an end side thereof below bristles of a displaceable brake ring which forms a slot with the outer surface of the drum, radially inwardly into a region of a tip of a head cone, the tip being directed towards an opening in the thread withdrawal eye formed as an axial suction-blast nozzle. A curved surface extends in a thread blowing direction into a horizontal surface deflecting the thread at the exit mouth side of the thread guide tube with the latter being obliquely upwardly directed during the automatic threading. The nozzle effects a radially inward deflection directed towards the nozzle of an end of the thread flying free in a plane vertically above the nozzle exclusively by a stream of suction air along an outer surface of the head cone. The outer surface of the head cone extends in the plane and forms a linear guide surface for the end of the thread, the linear guide surface extending from the outer surface of the drum to the tip of the head cone.

16 Claims, 8 Drawing Sheets

47
44
40
32
46
45
39
34
41

DELIVERY DEVICE WITH AUTOMATIC THREADING SYSTEM FOR WEFT STORAGE DRUM

FIELD AND BACKGROUND OF THE INVENTION

The present invention relates to a delivery device for travelling threads, particularly for use on textile machines.

A delivery device of a type is known from Federal Republic of Germany OS No. 37 34 284, in which the thread end which is conducted by compressed air through the thread guide tube, after leaving the thread guide tube in the region in front of the storage drum, is deflected into a radially slit guide channel by a blast nozzle which is directed approximately parallel to the axis of the drum. Said guide channel passes through the brake ring in the region of the root of the bristles and, on the other side of the brake ring, forms a channel section which is curved in the direction towards the axis of the drum. Into it, another blast nozzle debouches in such a manner that its jet extends radially to the axis of the drum and deflects the thread into a channel-like, approximately triangular section of the head cone. The thread end is conducted through said section into the region of a suction-blast nozzle. This development has the disadvantage of the expensive construction of the thread delivery device due to the blast air nozzles required at the deflection places and additional channels.

The object of the present invention is so to improve and develop a delivery device of the aforementioned type in a manner which is simple to manufacture that an automatic, reliable threading of the thread is made possible with minimum expense for parts and nozzles.

SUMMARY OF THE INVENTION

The invention provides a delivery device of abovementioned type for traveling threads which is of simple construction and is characterized by a reliable threading of the thread by means of compressed air. The number of nozzles operating with compressed air is reduced to a minimum. The thread, which is blown through the thread-guide tube, now emerges in a plane vertically above the thread withdrawal eye in such a manner that the end of the thread extends approximately parallel to the outer surface of the drum and is then taken up by the stream of suction air along the outer surface of the head cone and conveyed further, passing through the thread withdrawal eye. This is done with the utilization of the force of gravity acting on the end of the thread, which supports the threading process. The end of the thread is, therefore, always reliably grasped and pulled into the thread withdrawal eye. Additional deflection nozzles for obtaining a suitable direction of the thread can accordingly be omitted, resulting in reduced cost of manufacture of the delivery device. Channelizing of the head cone is also not necessary so that it can retain its smooth surface, which favors the withdrawal of the thread. Furthermore, the development in accordance with the invention makes it possible to operate with ordinary, available values of compressed air.

According to a feature of the invention the threading process is further supported by arranging the suction-blast nozzle associated with the thread withdrawal eye in a baffle wall for the blast stream emerging from the thread guide tube. Accordingly, the baffle wall fulfills a two-fold function: On the one hand, it serves to hold the suction-blast nozzle while, on the other hand, it represents another deflection wall for the end of the thread so that the latter does not shoot past beyond the suction-blast nozzle but rather favors the threading process.

Advantages in manufacture of the delivery device furthermore result from another feature of the invention wherein a suction-blast nozzle in front of the entrance-side end of the thread guide tube. This suction-blast nozzle can be of the same construction as the thread withdrawal eye which is developed as axial suction-blast nozzle, resulting in a reduction in the number of different parts. In order to make the threading of the thread possible, the brake ring must furthermore have been displaced in the axial direction of the storage drum in such a manner that its bristles leave a gap towards the outer surface of the drum so that the end of the thread can proceed along its intended path below the bristles. According to a feature of the invention, in order to obtain a favorable position of the brake ring in its operating and disengaged positions, the brake ring is arranged displaceably on a displacement slide. Regardless of the displacement stroke of the brake ring, the individual adjustment can, therefore, always take place. The thread guide tube, which is curved at a curved surface in the axial direction of the drum, always deflects the end of the thread in such a manner that it is directed into the slot which has been previously left. The end of the thread, therefore, always passes, as intended, to the thread withdrawal eye.

In a variant of the invention in which a correspondingly curved guide end is absent on the thread guide tube, the taking over and deflection of the thread can be effected by a deflection channel which extends in axial direction and into which the discharge end of the thread guide tube is directed. By the suction-blast nozzle arranged on the entrance-side end of the thread guide tube, the thread end is, therefore, always brought up into the suction region of the thread withdrawal eye which is developed as an axial suction-blast nozzle. These two suction-blast nozzles operate in accordance with the Venturi principle. In detail, the suction-blast nozzles are developed in the manner that an annular chamber is present in front of their annular slot. The wall on the annular slot slide which is necessary for the formation of said chamber is provided with a ring of air passage holes. Accordingly, there is a uniform feeding of the annular slot with compressed air, thereby obtaining optimum suction-blast action. In this connection, there is a possibility of feeding both suction-blast nozzles via a common valve. Expensive sequential controls can, therefore, be dispensed with. The moving up and back of the brake ring, which is controlled parallel to the supplying of the suction-blast nozzles, also contributes to this. In detail, the brake ring is moved away by means of a compressed-air cylinder and brought back again by spring force.

The feature that the baffle wall is seated on an upper jib which mounts the displacement slide of the brake ring serves to simplify manufacture. Accordingly, one part is used for several purposes. The bristles produce a favorable thread deflection effect due to the fact that they are aligned in accordance with the outer surface of the head cone. The adjustment of the bristles can be effected in simple fashion by means of a set screw which is accessible from the head end. Upon the turning thereof, the displacement slide which bears the brake ring changes its position with respect to the storage drum. This set screw passes through an opening in the baffle wall and can be actuated from there. The region of the outer surface of the head cone lying behind the baffle wall extends linearly from the base edge up to the tip of the cone, resulting in a favorable deflection of the thread. The thread cone, in its turn, terminates in front of the suction-blast nozzle located there. It should furthermore be emphasized that the air supply of both suction-blast nozzles is approximately the same so that one can operate with the same pressure and identical line cross sections which also contributes to simplification of the construction of the delivery device.

BRIEF DESCRIPTION OF THE DRAWINGS

Two embodiments of the invention will be explained below with reference to the drawings, in which.

DETAILED DESCRIPTION OF THE PREFERRED EMBODIMENTS

Figure 1:
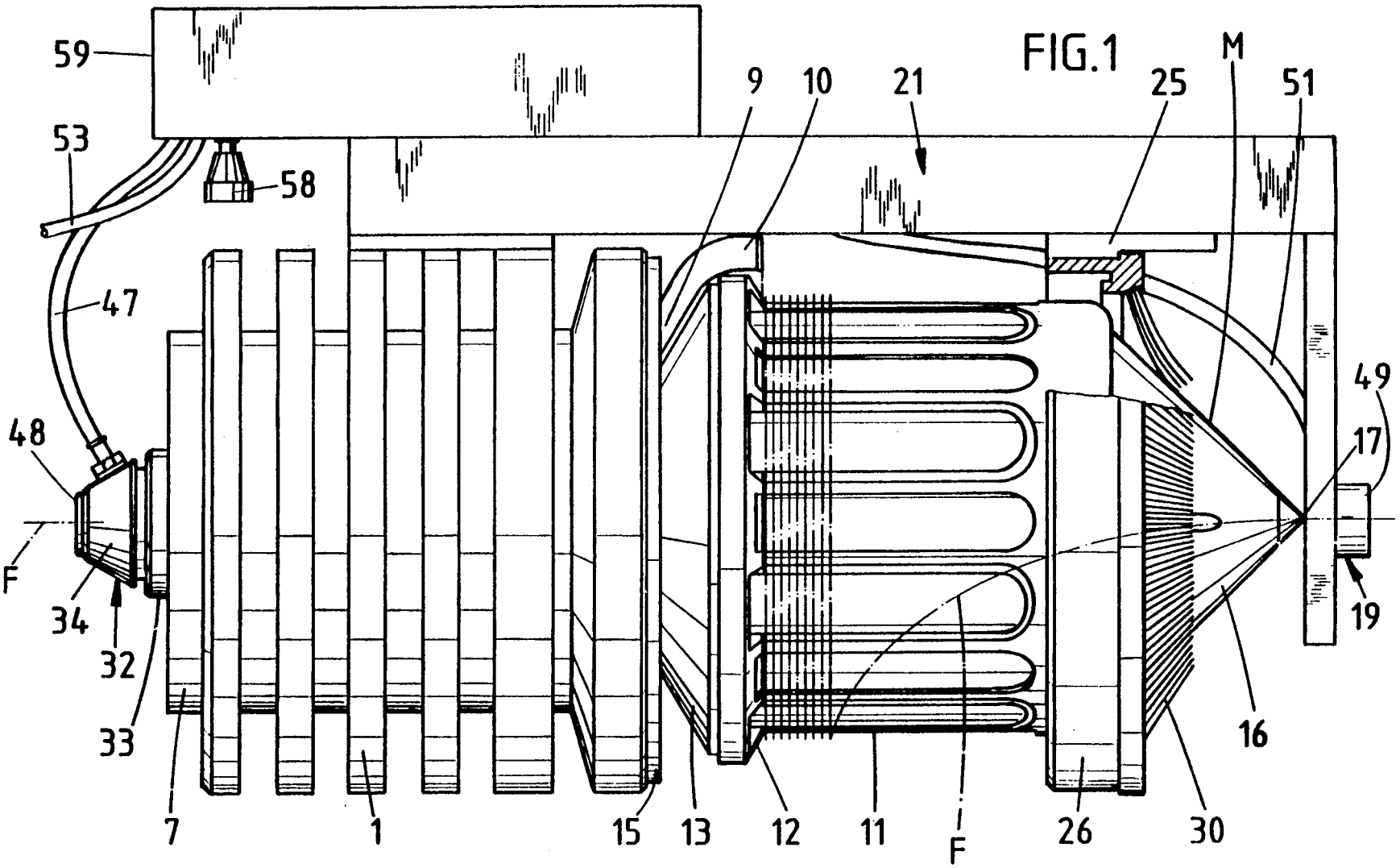
FIG. 1 shows a delivery device for travelling threads in accordance with the first embodiment, seen in front view.
Figure 2:
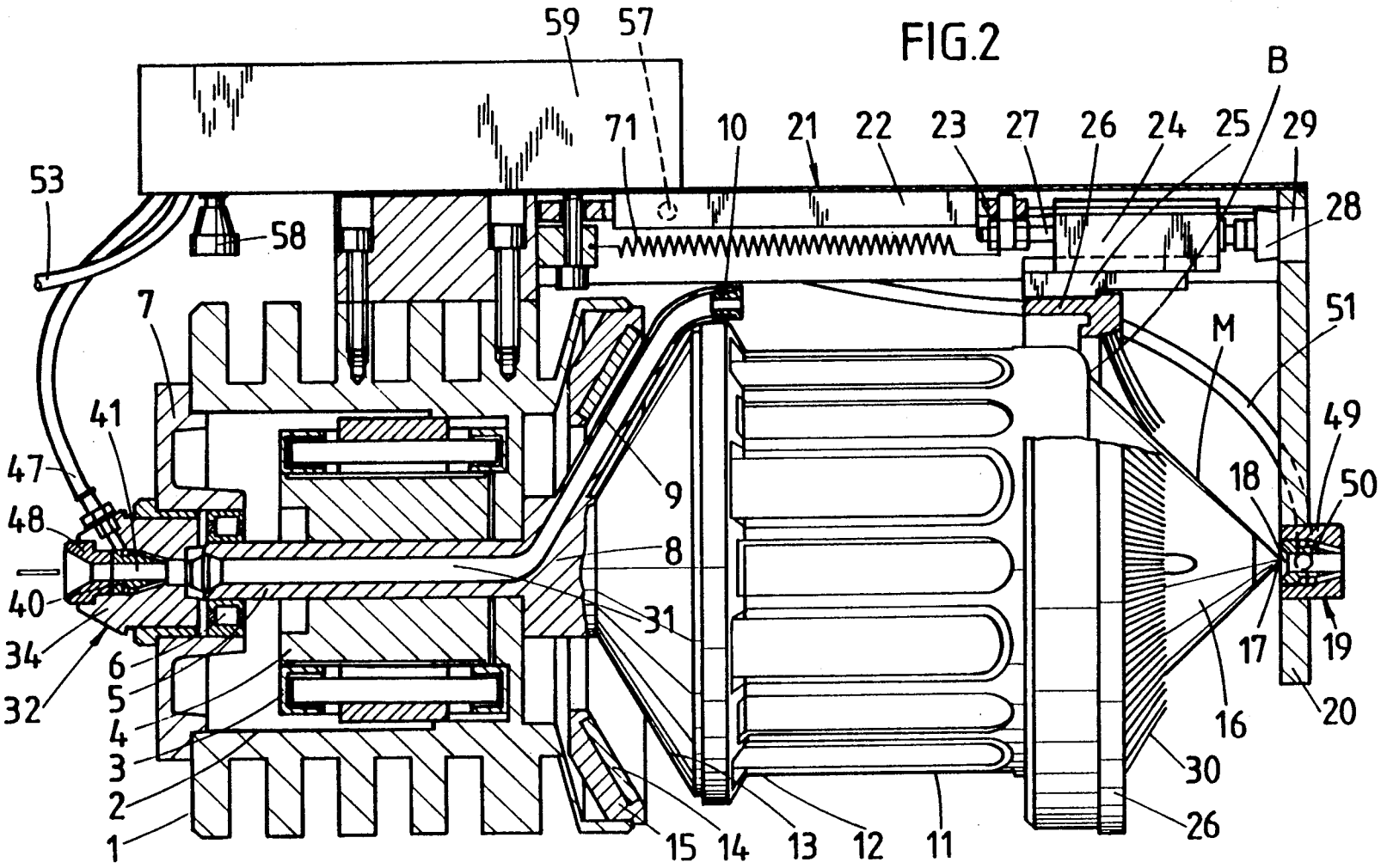
FIG. 2 shows, partially in longitudinal section and partially in front view, the thread delivery device before the threading of the thread.
Figure 3:
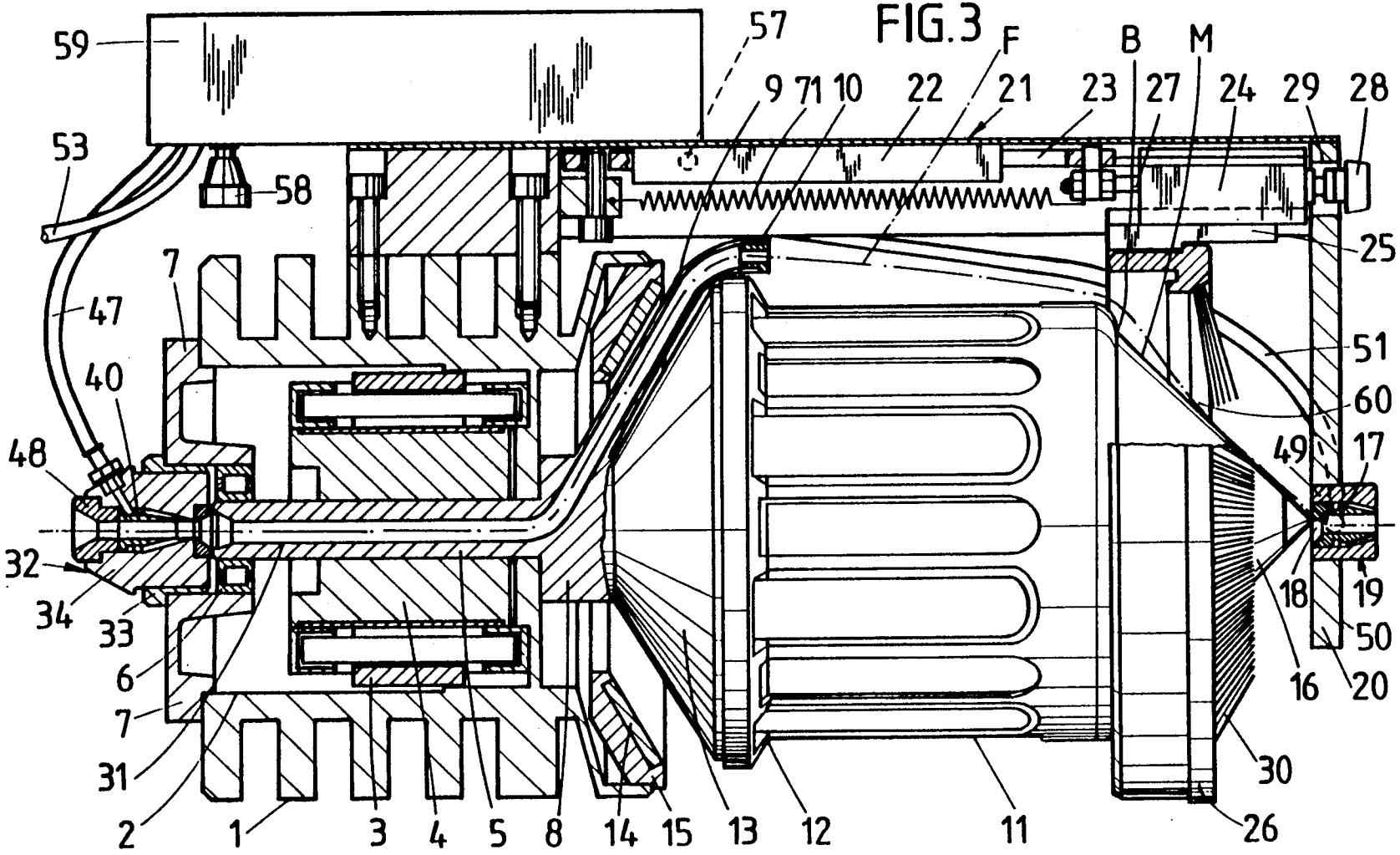
FIG. 3 is a showing which corresponds to FIG. 2 but with the brake ring displaced in axial direction to the storage drum with the thread threaded.
Figure 4:
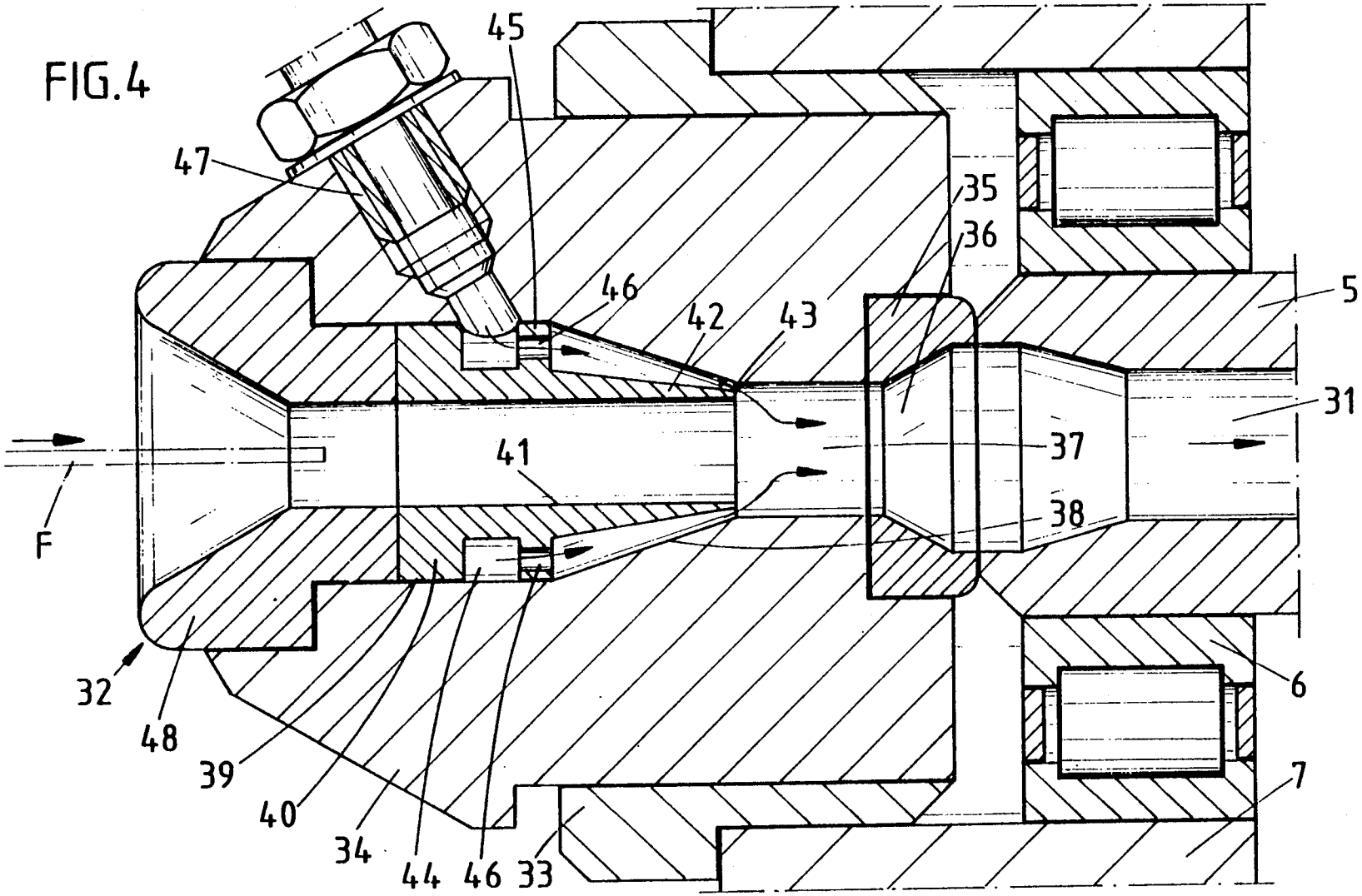
FIG. 4 shows, greatly enlarged, a longitudinal section through the suction-blast nozzle present on the entrance-side end of the thread guide tube, the nozzle corresponding in its construction to the suction-blast nozzle present on the withdrawal-side end.
Figure 5:
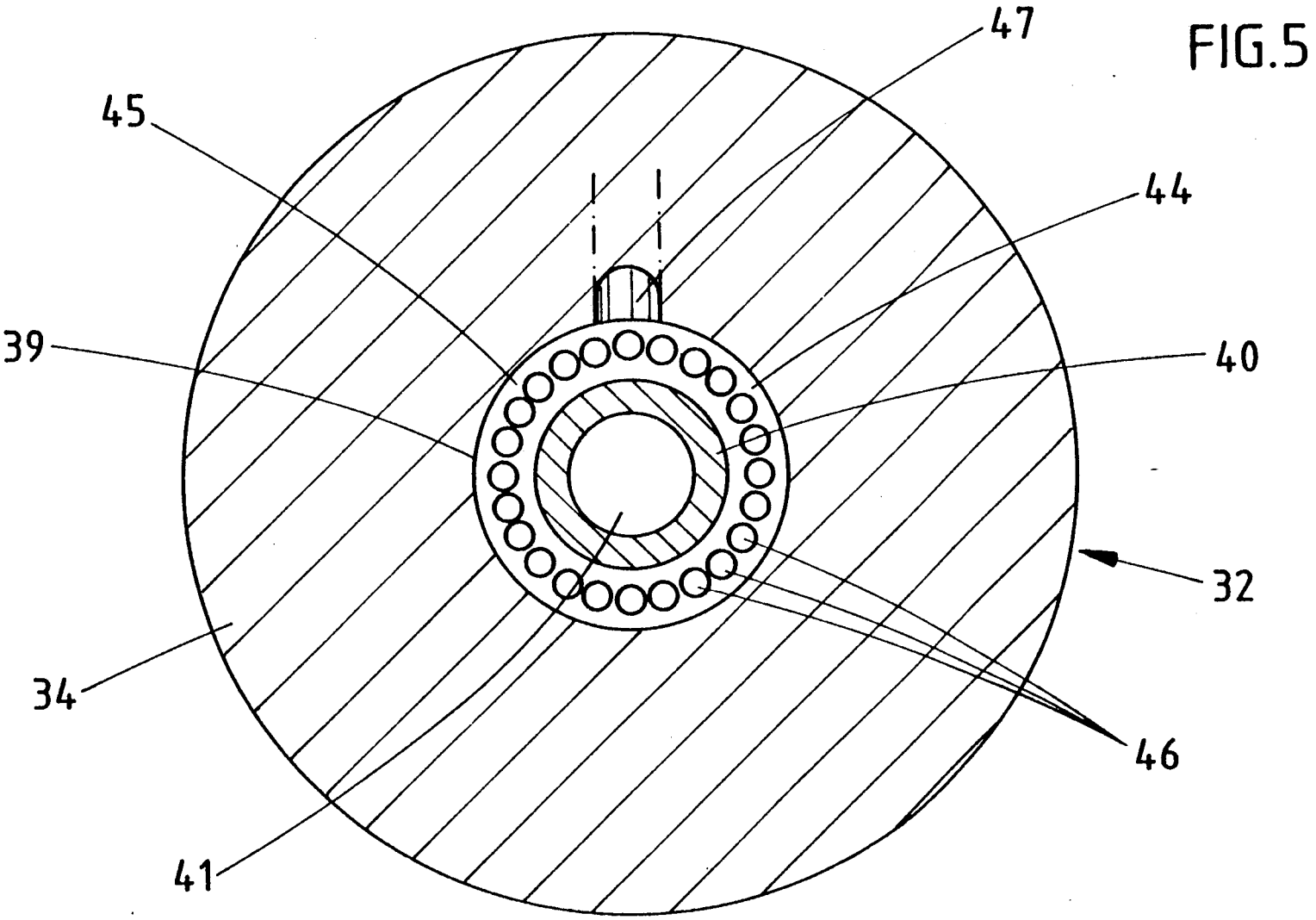
FIG. 5 is a cross section through the suction-blast nozzle at the height of the annular chamber, seen in the direction of the annular-slot-side wall provided with air passage holes.
Figure 6:
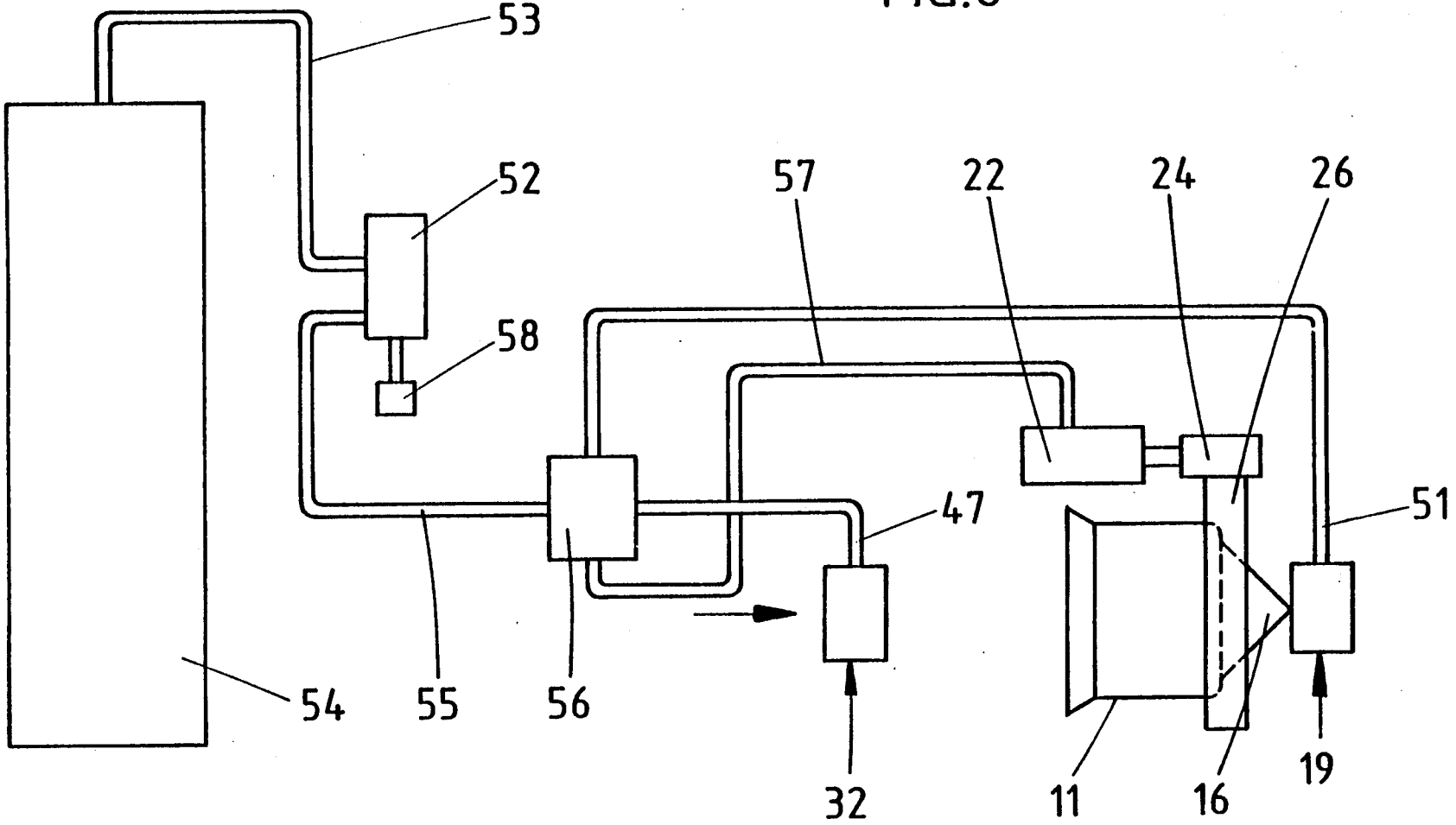
FIG. 6 is a block diagram with respect to the compressed-air action of the suction-blast nozzles and of the compressed-air cylinder associated with the brake ring.

The delivery device in accordance with the first embodiment, shown in FIG. 1–6, has a housing 1 intended to be fastened, for instance, to a girder of a loom. The housing receives, in a cavity 2 in the housing, a stator 3 in which a rotor 4 rotates. The rotor is passed through by a rotor shaft 5. The thread feeding end thereof is seated in an anti-friction bearing 6 which is arranged in a cover 7 which closes off the housing cavity 2.

From a collar 8 of the rotor shaft 5, which is of larger cross section and faces away from the threading end, an inclined thread guide tube 9 extends, the mouth end 10 of which is bent in axial direction of a storage drum 11 arranged coaxially to the rotor shaft 5. At the height of the mouth end 10, the storage drum 11 forms a thread run-on frustoconical surface 12 so that, upon rotation of the thread guide tube 9, the rear turns of the thread push the front turns already present on the storage drum towards the head end of the storage drum 11. The storage drum itself is rotatable. In order, however, that it does not rotate together with the thread guide tube 9, it is firmly attached to a conical frustum 13 which is provided with magnets (not shown). The magnets thereof are located opposite fixed magnets 14 of a ring 15 on the housing.

On its freely extending end, the storage drum 11 has a head cone 16. The base of this cone lies against the front of the storage drum and is somewhat smaller than the diameter of the storage drum 11. The outer wall region M of the head cone 16 proceeds from the base edge B and extends in linear direction to the tip 17 of the cone. The latter extends to the inlet opening 18 of a thread withdrawal eye 19.

As support for said thread withdrawal eye 19 there is a baffle wall 20 which extends vertically and is held at its upper end by a jib 21 of U-shaped cross section which is fastened to the housing 1. The jib 21, which extends beyond the storage drum 11 is located at such a parallel distance from the storage drum 11 that it does not interfere with the rotary movement of the thread guide tube 9.

The jib 21 contains within it a compressed-air cylinder 22. The piston rod 23 of the latter acts on a displacement slide 24 which is guided for longitudinal displacement in the inside of the jib 21. Relative to it, a support 25 for a brake ring 26 which travels concentrically to the axis of the storage drum is guided. The displacement slide 24 bears a set screw 27 for the actuating end 28 of which the baffle wall 20 forms an opening 29. A longitudinal displacement of the support 25 takes place hand in hand with the turning of the actuating handle 28, as a function of the direction in which the brake ring 26 is to be displaced.

The brake ring 26 is provided with bristles 30 directed towards the inside of the drum in such a manner that the bristles are directed as a skirt in accordance with the outer surface of the head cone 16. In the operating position, the bristle ends lie against the head cone 16 of the storage drum 11.

The thread guide tube 9 is continued in a thread channel 31 which passes centrally through the rotor shaft and widens at the threading-side end. There, a suction-blast nozzle 32 is provided in the housing cover 7. Within a central opening of the housing cover 7, there is a spacer bushing 33 in which the nozzle housing 34 is fixed. The nozzle housing 34 receives at the end thereof facing the rotor shaft 5 a sealing collar 35 which extends up to the free end of the rotor shaft 5. Accordingly, the thread channel 31 directly adjoins the outlet opening 36 of the sealing collar 35. The outlet opening 36, in its turn, is in communication with a short passage channel 37 of the nozzle body 34, which channel 37 then widens to form a frustoconical channel 38 and then passes into a circular-cylindrical channel section 39. A nozzle body 40 is pressed into the latter. In its center, it forms a thread-passage channel 41 which is smaller in diameter than the flow channel 37 in the nozzle body 34. Approximately at half its length facing the flow channel 37, the nozzle body 40 is provided with a frustoconical section 42, the cone angle of which is less than that of the frustoconical channel 38. The smallest diameter of the frustoconical section 42 is smaller than that of the flow channel 37 so that an annular slot 43 accordingly remains. On its cylindrically shaped remaining length the nozzle body 40 forms an annular chamber 44, in the wall 45 of which, facing the annular slot, a ring of air passage holes 46 is provided. A compressed-air feed line 47 debouches into the annular chamber 44. In front of the nozzle body 40 there is also a threading eye 48 which, in its turn, is firmly embedded in the nozzle housing 44.

The thread withdrawal eye 19 is also developed as a suction-blast nozzle. It has a nozzle housing 49 which is inserted into the baffle wall 20 and a nozzle body 50 the construction of which corresponds to that of the suction-blast nozzle 32. A common valve 52 is associated with the feed lines 47, 51 of both suction-blast nozzles 19, 32. Said valve is in communication, via a compressed-air line 53, with a source of compressed air 54. From the valve 52, a feed line 55 extends to a distributor 56 which is in communication with both the feed lines 47, 51 and the feed line 57 which leads to the compressed-air cylinder 22. The valve 52 can be controlled by means of a handle 58. By the inward displacement of said handle, both the suction-blast nozzles 19, 32 and the compressed-air cylinder 22 are fed via the compressed air line 53 and feed line 55 via the distributor 56, the compressed-air cylinder displacing the brake ring 26 in axial direction in such a manner that its bristles enter into a slot-forming position with respect to the outer surface of the drum; see slot 60 in FIG. 3.

Said handle 58 is advantageously located on a box 59 which is attached to the housing 1 and in which the valve 52 as well as the distributor 56 and the corresponding connections are arranged.

The baffle wall 20, which receives the suction-blast nozzle 19, corresponds in its width approximately to $\frac{1}{3}$ of the diameter of the storage drum 11.

Before the threading of a thread F, the rotor shaft 5 is stopped in such a position that the thread guide tube 9 extending from the collar 8 or its mouth end 10 lies in a plane vertically above the thread withdrawal eye 19. The handle 58 is then actuated, whereby the suction-blast nozzles 19, 32 simultaneously receive compressed air. This is true also of the compressed-air cylinder 22 which, via its piston rod 23 and displacement slide 24, displaces the brake ring 26 so that the bristles of the latter pass into a slot-forming position; see FIG. 3. The end of the thread is now to be brought into the region of the threading eye 48. As a result of the compressed air which enters into the annular chamber 44 and travels through the air passage holes 46 and from there leaves the annular slot 43 in order to enter into the thread channel 31, there is produced in the thread-passage channel 41 a vacuum by which the thread F is pulled in. As soon as the thread F passes into the flow channel 37, it is carried along by the air which emerges with pressure there and conveyed further through the thread guide tube 9. The thread end, acted on by compressed air, leaves the mouth end 10 of the thread guide tube 9, and passes approximately parallel above the storage drum 11 and through the slot 60 between storage drum 11 and bristles 30 of the brake ring 26. The deflection, which is directed radially inwards towards the thread withdrawal eye 19, then takes place by means of the stream of suction air lying on the outer surface of the head cone 16, which deflection is supported by the gravitational force of the thread end. The baffle wall 20 in this connection represents a limitation of the flow path so that the thread end does not go beyond the baffle wall but definitely arrives at the withdrawal eye 19, shaped as a suction-blast nozzle, and from there emerges, also in accordance with the Venturi principle, from the latter. After the threading of the thread F the handle 58 can move back into its starting position, interrupting the feed of compressed air. A spring spring 71 arranged in the compressed-air cylinder 22 brings the brake ring 26 back into its starting position.

Figure 7:
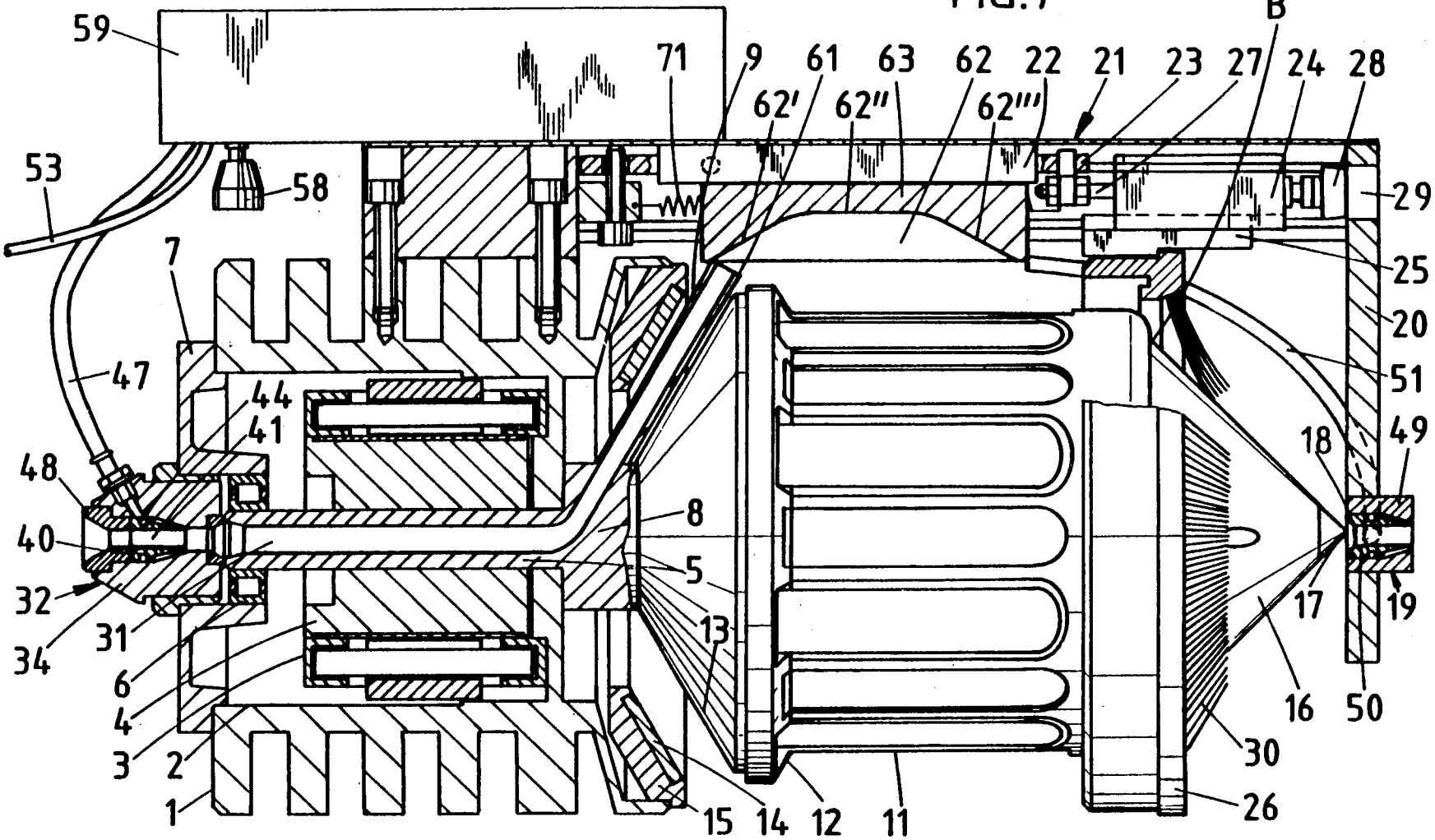
FIG. 7 shows, partially in longitudinal section and partially in front view, the delivery device in accordance with the second embodiment.
Figure 8:
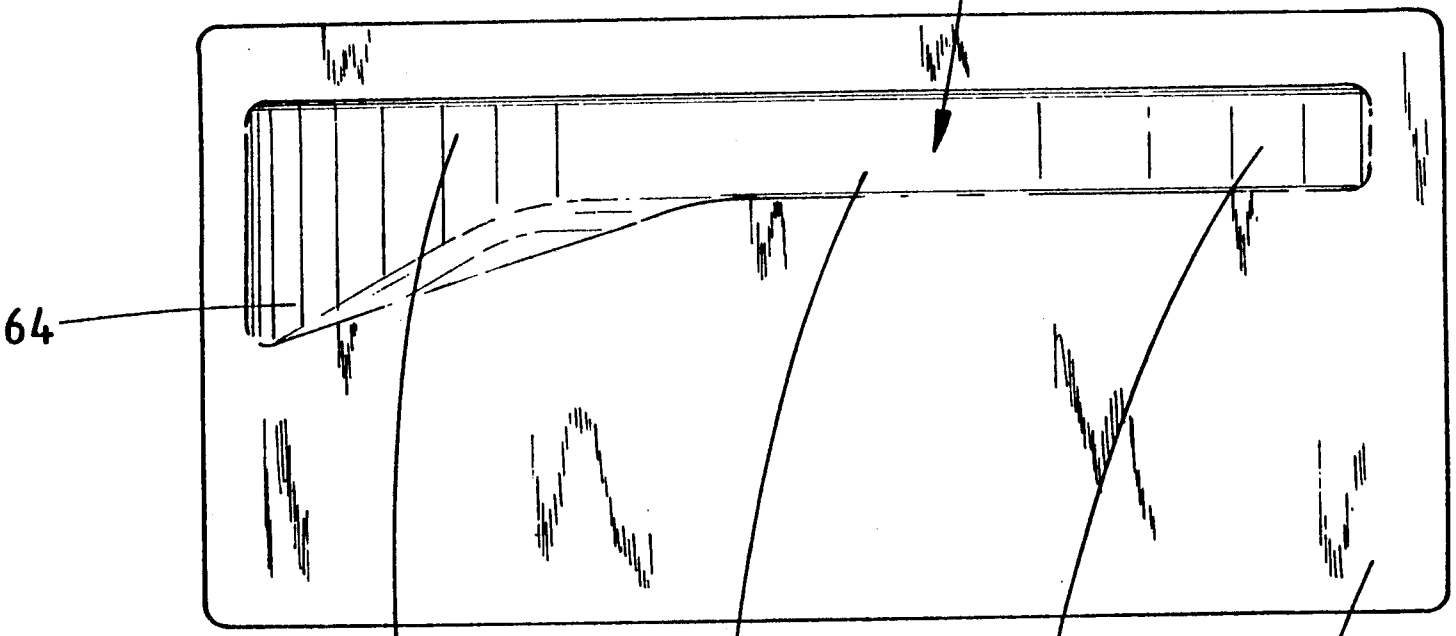
FIG. 8 is a bottom view of the block having the deflection channel.

In the second embodiment shown in FIGS. 7 and 8, identical parts bear the same reference numbers. Differing from the first embodiment, the curved mouth end 10 on the thread guide tube 9 is lacking. The mouth end 61, which in the second embodiment extends in the same direction towards the thread guide tube, is directed into a deflection channel 62 which extends parallel to the axial direction of the storage drum. Said channel is located in a block 63 which is inserted in the jib 21 and extends below the compressed-air cylinder 22. The deflection channel 62 has three adjacent bottom sections 62', 62'', 62'''. They are so arranged that the first bottom section 62' extends, rising at an acute angle in the direction of the thread passage and deflects the end of the thread to the bottom section 62'' which is directed parallel to the axis of the drum. The third bottom section 62''' passes in opposite direction at an acute angle to the axis of the drum and deflects the end of the thread into the slot 60 between bristles 30 and storage drum in the direction of the head cone 16, baffle wall 20 and suction-blast nozzle 19. The threading process is also effected with the handle 58 depressed. The deflecting of the thread is now effected in the transition region between mouth end 61 and suction-blast nozzle 19 by the deflection channel 62 so that, also in this version, additional deflection nozzles can be dispensed with. The entrance-side funnel-shaped widening 64 of the deflection channel 62 acts to facilitate the threading process.

Furthermore, in this version the threading of the thread always takes place in the position in which the mouth end 61 of the thread guide tube 9 is located in a plane vertically above the thread withdrawal eye. Then both gravity and the corresponding wall surface of the head cone which is located in the same plane can be used for the guiding of the thread.

I claim:

1. In a delivery device for traveling thread, for use on textile machines having a storage drum to which the thread is fed in a rearward region by means of a thread guide tube which revolves around the storage drum and from which the thread is withdrawn overhead through a thread withdrawal eye and wherein an automatic threading of the thread is effected by means of compressed air in a manner wherein the thread is first of all blown through the thread guide tube, deflected at an exit mouth side thereof parallel to an outer surface of the drum and conducted on an end side thereof below bristles of a displaceable brake ring which leaves a slot towards the outer surface of the drum, radially inwardly into a region of a tip of a drum-side head cone, said tip being directed towards a free cross section of the thread withdrawal eye, the latter being formed as an axial suction-blast nozzle, the improvement in the delivery device further comprising means comprising a curved surface which extends in a direction of blowing of the thread into a horizontal surface for deflecting the thread at said exit mouth side of said thread guide tube with the latter being obliquely upwardly directed during the automatic threading of the thread, said axial suction-blast nozzle constitutes means for effecting a radially inward deflection directed towards the thread withdrawal eye of an end of the thread flying free in a plane vertically above the thread withdrawal eye exclusively by a stream of suction air along an outer surface of the head cone, and wherein said outer surface of the head cone extends from said plane and forms a linear guide surface for the end of the thread, said linear guide surface extending from the outer surface of the drum to the tip of the head cone, and said bristles of said brake ring form a skirt adjacent an upper section of said head cone.

2. A delivery device according to claim 1, wherein said suction-blast nozzle associated with the thread withdrawal eye is arranged in a baffle wall for a blast stream emerging from the thread guide tube.

3. A delivery device according to claim 1, wherein said suction-blast nozzle is in front of an entrance-side end of said thread guide tube.

4. A delivery device according to claim 1, further comprising a displacement slide, and wherein said brake ring, which is to be brought into a slot position by a displacement in axial direction of the storage drum, is seated in an adjustable manner on said displacement slide.

5. A delivery device according to claim 1, wherein a mouth end of the thread guide tube at said exit mouth side is curved in the axial direction of the storage drum and constitutes said curved surface.

6. A delivery device according to claim 1, wherein a mouth end of the thread guide tube at said exit mouth side is directed into a deflection channel which extends in the axial direction, said deflection channel constitutes said curved surface.

7. A delivery device according to claim 1, further comprising a wall forming an annular chamber arranged in front of an annular slot of said suction-blast nozzle, and a ring of air passage holes is located within said wall.

8. A delivery device according to claim 1, further comprising an input side axial suction-blast nozzle communicates with said thread guide tube for blowing the compressed air into said thread guide tube, and a common valve associated with feed lines of said suction-blast nozzles.

9. A delivery device according to claim 1, further comprising means for moving said brake ring forwardly away together with supplying said suction-blast nozzle with the compressed air.

10. In a delivery device for traveling thread, for use on textile machines having a storage drum to which the thread is fed in a rearward region by means of a thread guide tube which revolves around the storage drum and from which the thread is withdrawn overhead through a thread withdrawal eye and wherein an automatic threading of the thread is effected by means of compressed air in a manner wherein the thread is first of all blown through the thread guide tube, deflected on a mouth side thereof parallel to an outer surface of the drum and conducted on an end side thereof below bristles of a displaceable brake ring which leaves a slot towards the outer surface of the drum, radially inwardly into a region of a tip of a drum-side head cone, said tip being directed towards a free cross section of the thread withdrawal eye, the latter being formed as an axial suction-blast nozzle, the improvement in the delivery device wherein said axial suction-blast nozzle constitutes means for effecting a radially inward deflection directed towards the thread withdrawal eye of an end of the thread flying free in a plane vertically above the thread withdrawal eye exclusively by a stream of suction air along an outer surface of the head cone, means for moving said brake ring forwardly away together with supplying said suction-blast nozzle with the compressed air, a compressed-air cylinder for moving the brake ring away, and spring means for return biasing the brake ring.

11. In a delivery device for traveling thread, for use on textile machines having a storage drum to which the thread is fed in a rearward region by means of a thread guide tube which revolves around the storage drum and from which the thread is withdrawn overhead through a thread withdrawal eye and wherein an automatic threading of the thread is effected by means of compressed air in a manner wherein the thread is first of all blown through the thread guide tube, deflected on a mouth side thereof parallel to an outer surface of the drum and conducted on an end side thereof below bristles of a displaceable brake ring which leaves a slot towards the outer surface of the drum, radially inwardly into a region of a tip of a drum-side head cone, said tip being directed towards a free cross section of the thread withdrawal eye, the latter being formed as an axial suction-blast nozzle, the improvement in the delivery device wherein said axial suction-blast nozzle constitutes means for effecting a radially inward deflection directed towards the thread withdrawal eye of an end of the thread flying free in a plane vertically above the thread withdrawal eye exclusively by a stream of suction air along an outer surface of the head cone, a displacement slide, and wherein said brake ring, which is to be brought into a slot position by a displacement in axial direction of the storage drum, is seated in an adjustable manner on said displacement slide, an upper jib supports said displacement slide, and a baffle wall is seated on said upper jib.

12. A delivery device according to claim 1, wherein said bristles are directed toward the outer surface of the head cone.

13. In a delivery device for traveling thread, for use on textile machines having a storage drum to which the thread is fed in a rearward region by means of a thread guide tube which revolves around the storage drum and from which the thread is withdrawn overhead through a thread withdrawal eye and wherein an automatic threading of the thread is effected by means of compressed air in a manner wherein the thread is first of all blown through the thread guide tube, deflected on a mouth side thereof parallel to an outer surface of the drum and conducted on an end side thereof below bristles of a displaceable brake ring which leaves a slot towards the outer surface of the drum, radially inwardly into a region of a tip of a drum-side head cone, said tip being directed towards a free cross section of the thread withdrawal eye, the latter being formed as an axial suction-blast nozzle, the improvement in the delivery device wherein said axial suction-blast nozzle constitutes means for effecting a radially inward deflection directed towards the thread withdrawal eye of an end of the thread flying free in a plane vertically above the thread withdrawal eye exclusively by a stream of suction air along an outer surface of the head cone, a displacement slide on which said brake ring is seated, and means comprising a set screw for adjusting the brake ring by the displacement slide, said set screw being accessible from a head end of the delivery device.

14. In a delivery device for traveling thread, for use on textile machines having a storage drum to which the thread is fed in a rearward region by means of a thread guide tube which revolves around the storage drum and from which the thread is withdrawn overhead through a thread withdrawal eye and wherein an automatic threading of the thread is effected by means of compressed air in a manner wherein the thread is first of all blown through the thread guide tube, deflected on a mouth side thereof parallel to an outer surface of the drum and conducted on an end side thereof below bristles of a displaceable brake ring which leaves a slot towards the outer surface of the drum, radially inwardly into a region of a tip of a drum-side head cone, said tip being directed towards a free cross section of the thread withdrawal eye, the latter being formed as an axial suction-blast nozzle, the improvement in the delivery device wherein said axial suction-blast nozzle constitutes means for effecting a radially inward deflection directed towards the thread withdrawal eye of an end of the thread flying free in a plane vertically above the thread withdrawal eye exclusively by a stream of suction air along an outer surface of the head cone, an input side axial suction-blast nozzle, and means for making the air supply of said suction-blast nozzles approximately the same.

15. In a delivery device for traveling thread, for use on textile machines having a storage drum to which the thread is fed in a rearward region by means of a thread guide tube which revolves around the storage drum and from which the thread is withdrawn overhead through a thread withdrawal eye and wherein an automatic threading of the thread is effected by means of compressed air in a manner wherein the thread is first of all blown through the thread guide tube, deflected on a mouth side thereof parallel to an outer surface of the drum and conducted on an end side thereof below bristles of a displaceable brake ring which leaves a slot towards the outer surface of the drum, radially inwardly into a region of a tip of a drum-side head cone, said tip being directed towards a free cross section of the thread withdrawal eye, the latter being formed as an axial suction-blast nozzle, the improvement in the delivery device wherein said axial suction-blast nozzle constitutes means for effecting a radially inward deflection directed towards the thread withdrawal eye of an end of the thread flying free in a plane vertically above the thread withdrawal eye exclusively by a stream of suction air along an outer surface of the head cone, during the automatic threading of the thread, said revolvable thread guide tube has a mouth at said exit mouth side which is held positioned in said plane vertically above the thread withdrawal eye, said end of the thread emerging from said mouth during the automatic threading of the thread, and said outer surface of the drum continues from an edge thereof into said head cone meeting at an angle effecting a smooth deflection of said stream of suction air along said outer surfaces of the drum adjacent said edge and of the head cone, wherein gravity on the said thread and said stream of suction air along said outer surfaces adjust said thread to the outer surface of the head cone.

16. A delivery device according to claim 15, further comprising an axial inlet-side suction-blast nozzle communicating with an inlet of said thread guide tube for blowing the end of the thread into said inlet of said thread guide tube through said thread guide tube and out said mouth of said thread guide tube, said axial suction-blast nozzles effecting said automatic threading of the thread and adjusting the thread to the outer surface of the head cone without any other suction-blast nozzles.

* * * * *